US010780019B2

(12) United States Patent
Chang

(10) Patent No.: US 10,780,019 B2
(45) Date of Patent: Sep. 22, 2020

(54) VIBRATING GLASS MASSAGER

(71) Applicant: JOPEN LLC, Chino, CA (US)

(72) Inventor: Jack Chang, Thousand Oaks, CA (US)

(73) Assignee: Jopen LLC, Chino, CA (US)

( * ) Notice: Subject to any disclaimer, the term of this patent is extended or adjusted under 35 U.S.C. 154(b) by 725 days.

(21) Appl. No.: 15/361,033

(22) Filed: Nov. 24, 2016

(65) Prior Publication Data

US 2018/0140504 A1 May 24, 2018

(51) Int. Cl.

*A61H 19/00* (2006.01)
*A61H 23/02* (2006.01)
*A61H 99/00* (2006.01)

(52) U.S. Cl.

CPC ..... *A61H 23/02* (2013.01); *A61H 19/34* (2013.01); *A61H 19/44* (2013.01); *A61H 99/00* (2013.01); *A61H 2201/0165* (2013.01); *A61H 2201/169* (2013.01); *A61H 2201/50* (2013.01)

(58) Field of Classification Search

CPC ..... A61H 19/00; A61H 19/30; A61H 19/34; A61H 19/40; A61H 19/44; A61H 19/50

See application file for complete search history.

(56) References Cited

U.S. PATENT DOCUMENTS 5,076,261 A * 12/1991 Black ..... A61H 19/44 601/93
9,468,580 B2 * 10/2016 Lee ..... A61H 19/44
9,730,857 B1 * 8/2017 Loya ..... A61H 19/50
2009/0005714 A1 * 1/2009 Mecenero ..... A61H 19/34 601/46
2010/0174212 A1 * 7/2010 Shim ..... A61B 5/103 600/587
2013/0317290 A1 * 11/2013 Lee ..... A61H 19/44 600/38
2014/0357943 A1 * 12/2014 Greaves ..... A61H 23/02 600/38
2016/0120737 A1 * 5/2016 Sedic ..... A61H 19/34 601/46
2017/0095399 A1 * 4/2017 Lee ..... A61H 19/44
2017/0281458 A1 * 10/2017 Guang ..... A61H 19/34
2018/0289585 A1 * 10/2018 Murison ..... A61H 21/00

OTHER PUBLICATIONS

Glassfantasy, "Icicles 19 Pink Ribbed Glass Vibrator", GlassFantasy.com, Nov. 16, 2016, 2 pages.
Pipedream Products, "Icicles No. 20", Pipedreamproducts.com, Nov. 16, 2016, 1 page.

* cited by examiner

*Primary Examiner* — LaToya M Louis

(57) ABSTRACT

A vibrating glass massager includes a glass vibration head having a base end, a free end, and a wall defining a hollow interior compartment that is closed at the vibration head free end and open at the vibration head base end. A vibration motor assembly is disposed in the vibration head interior compartment. A resilient vibration-transmitting interface is disposed between the vibration motor assembly and the vibration head wall. A non-glass base includes a base housing. The base housing and the vibration head base end are joined in interlocking relationship at a head-base connection interface. A power source and a control circuit are disposed in the base housing. The control circuit is electrically connected to the power source and to the vibration motor assembly. The glass vibration head is operable to deliver vibrations received from the vibration motor assembly via the vibration transmitting interface.

19 Claims, 7 Drawing Sheets

VIBRATING GLASS MASSAGER

BACKGROUND

1. Field

The present disclosure relates to massage apparatus, and in particular, to vibrating massagers.

2. Description of the Prior Art

By way of background, there are many shapes and sizes of vibrator devices for massaging/stimulating various areas of the human anatomy. Typically, such devices have been constructed with a rigid polymer or metal housing having a vibration motor inside a vibrating end of the housing, and control/power supply components inside a base end of the housing. The base end of the housing is sometimes covered with a soft silicone rubber sleeve.

It is to improvements in the field of vibrating massagers that the present disclosure is directed. In particular, the present disclosure is directed to a vibrating massager whose vibrating end is formed from a non-polymeric, non-metallic material.

SUMMARY

A vibrating glass massager includes a glass vibration head having a base end, a free end, and a wall defining a hollow interior compartment that is closed at the vibration head free end and open at the vibration head base end. A vibration motor assembly is disposed in the vibration head interior compartment. A resilient vibration transmitting interface is disposed between the vibration motor assembly and the vibration head wall. A non-glass base includes a base housing. The base housing and the vibration head base end are joined in interlocking relationship at a head-base connection interface. A power source and a control circuit are disposed in the base housing. The control circuit is electrically connected to the power source and to the vibration motor assembly. The glass vibration head is operable to deliver vibrations received from the vibration motor assembly via the vibration transmitting interface.

In an embodiment, the vibration motor assembly may include a motor disposed within a vibration motor housing.

In an embodiment, the vibration transmitting interface may include one or more resilient shock absorbers disposed between the vibration motor assembly and the vibration head wall.

In an embodiment, the vibration transmitting interface may include one or more resilient shock absorbers disposed between a side portion of the vibration motor assembly and a side portion the vibration head wall, and a shock absorber disposed between an end of the vibration motor assembly and the closed end of the vibration head interior compartment.

In an embodiment, the vibration transmitting interface may include one or more foam elements disposed between the vibration motor assembly and a side portion of the vibration head wall.

In an embodiment, the vibration transmitting interface may include one or more foam elements disposed between the vibration motor assembly and a side portion of the vibration head wall, and may further include cotton wadding disposed between the vibration motor assembly and the closed end of the vibration head interior compartment.

In an embodiment, the head-housing connection interface may include a ring flange formed on the vibration head base end, a corresponding ring channel formed on the base housing that receives the ring flange, and a gasket member between the ring flange and the channel.

In an embodiment, an opaque coating may be provided on an interior of the vibration head wall.

In an embodiment, a resilient cover may be provided on the base housing.

In an embodiment, the vibration head interior compartment may include a nonlinear curvature extending from the vibration head base end to the vibration head free end, and the primary vibration head motor assembly may be spaced from the primary vibration head wall.

In an embodiment, a secondary non-glass vibration head may extend from the base, a secondary vibration motor assembly may be provided in the secondary vibration head and the secondary vibration motor assembly may be electrically connected to the control circuit.

In an embodiment, a resilient cover may be provided on the base housing, and the resilient cover may define the secondary vibration head.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
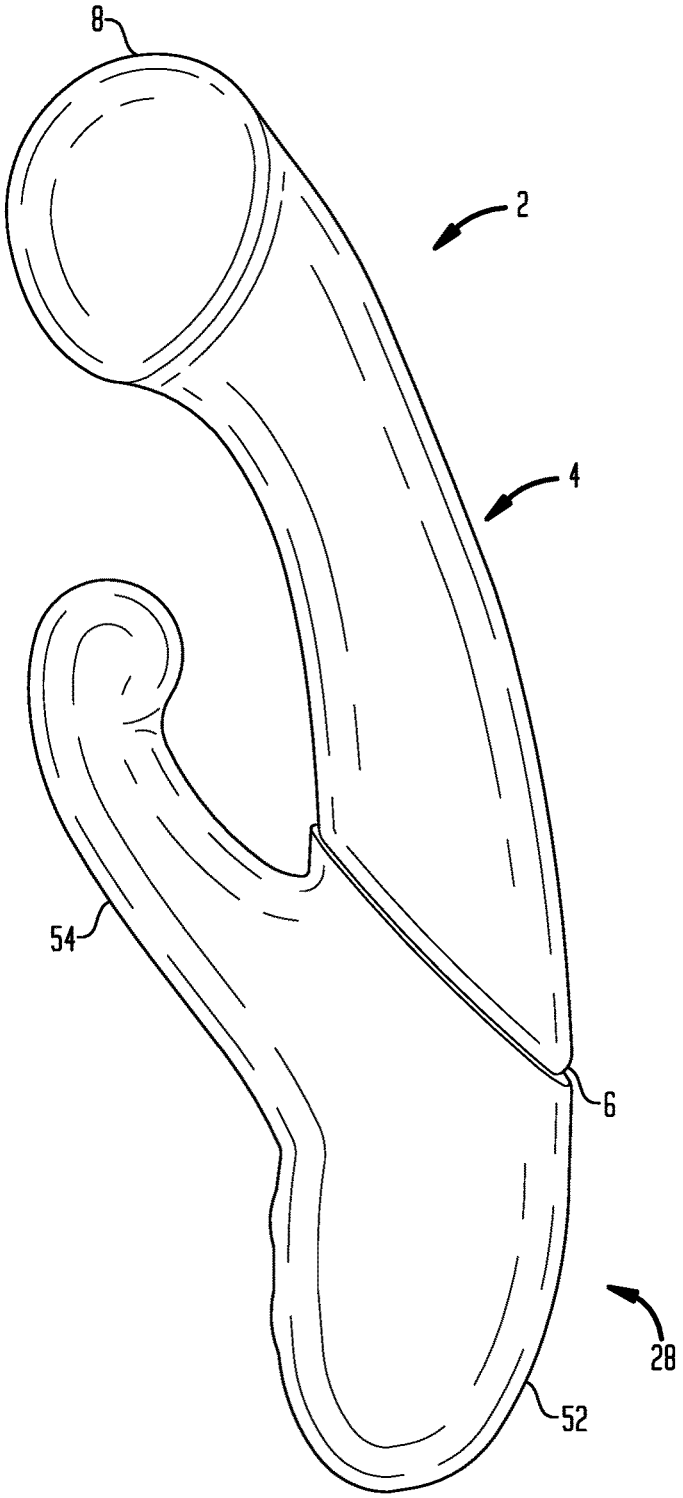
FIG. 1 is a side elevation view showing an example vibrating glass massager constructed in accordance with the present disclosure.
Figure 2:
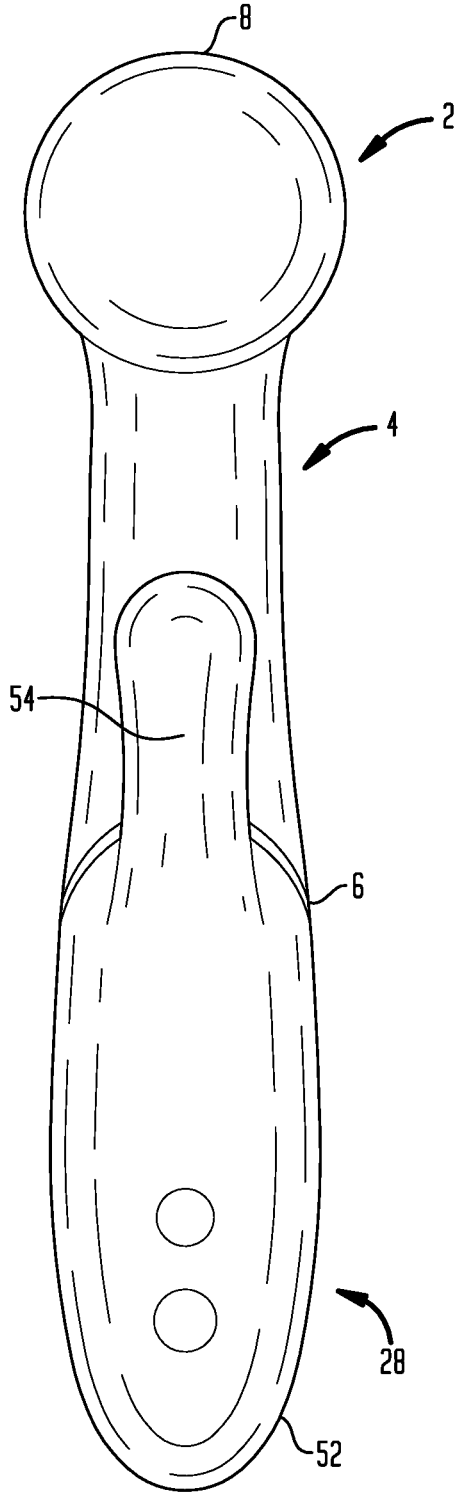
FIG. 2 is a front elevation view of the example massager of FIG. 1.

Turning now to the Drawing Figures, which are not necessarily to scale, FIGS. 1-2 illustrate an example vibrating glass massager 2 representing one possible embodiment of the present disclosure. The massager 2 includes a molded glass vibration head 4 having a base end 6 and a free end 8. Any suitable type of glass may be used, including but not limited to borosilicate glass. With additional reference to FIG. 4, the vibration head 4 has a wall 10 that defines a hollow interior compartment 12 of the vibration head. The interior compartment 12 is closed at the vibration head free end 8 and open at the vibration head base end 8.

Figure 3:
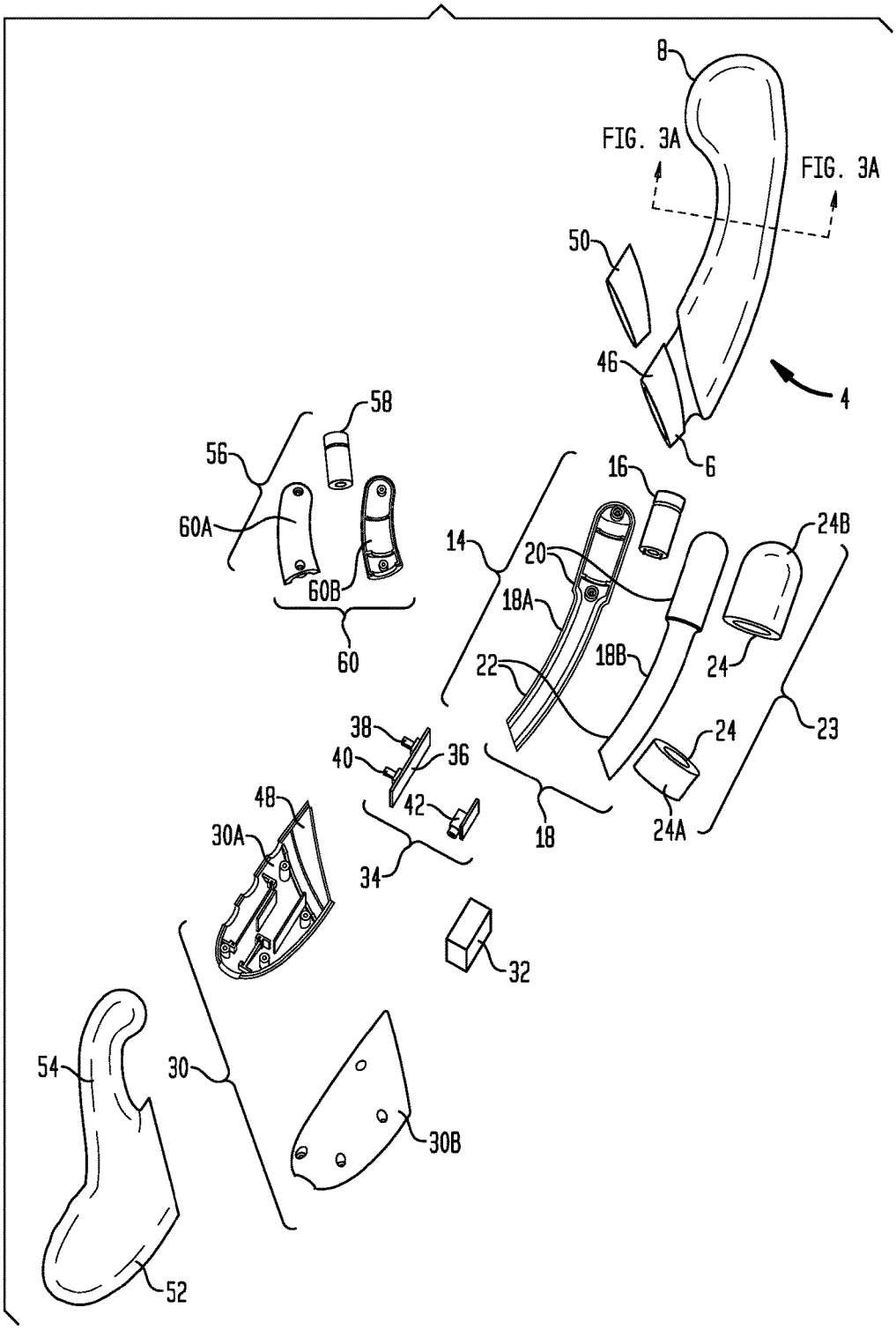
FIG. 3 is an exploded side view showing individual components of the example massager of FIG. 1.
Figure 4:
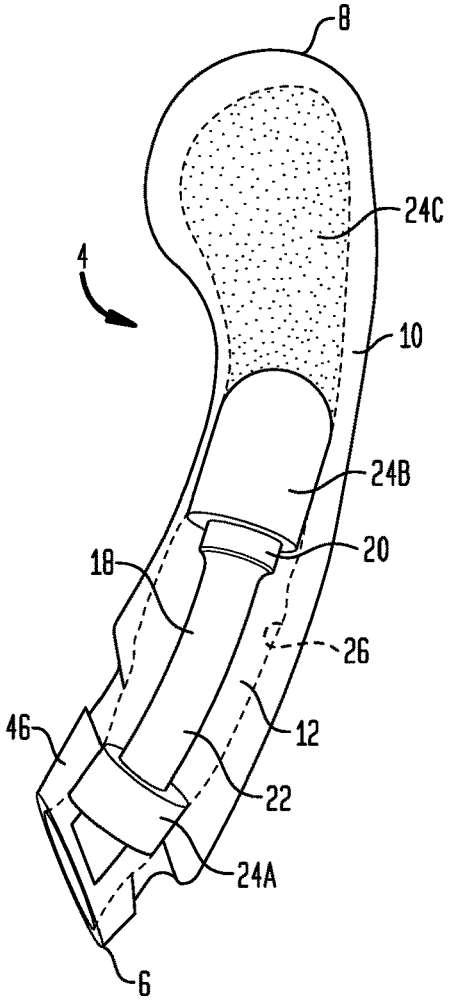
FIG. 4 is an exploded side view of a glass vibration head of the massager of FIG. 1 following installation of a vibration motor assembly and related components in the glass vibration head.
Figure 5:
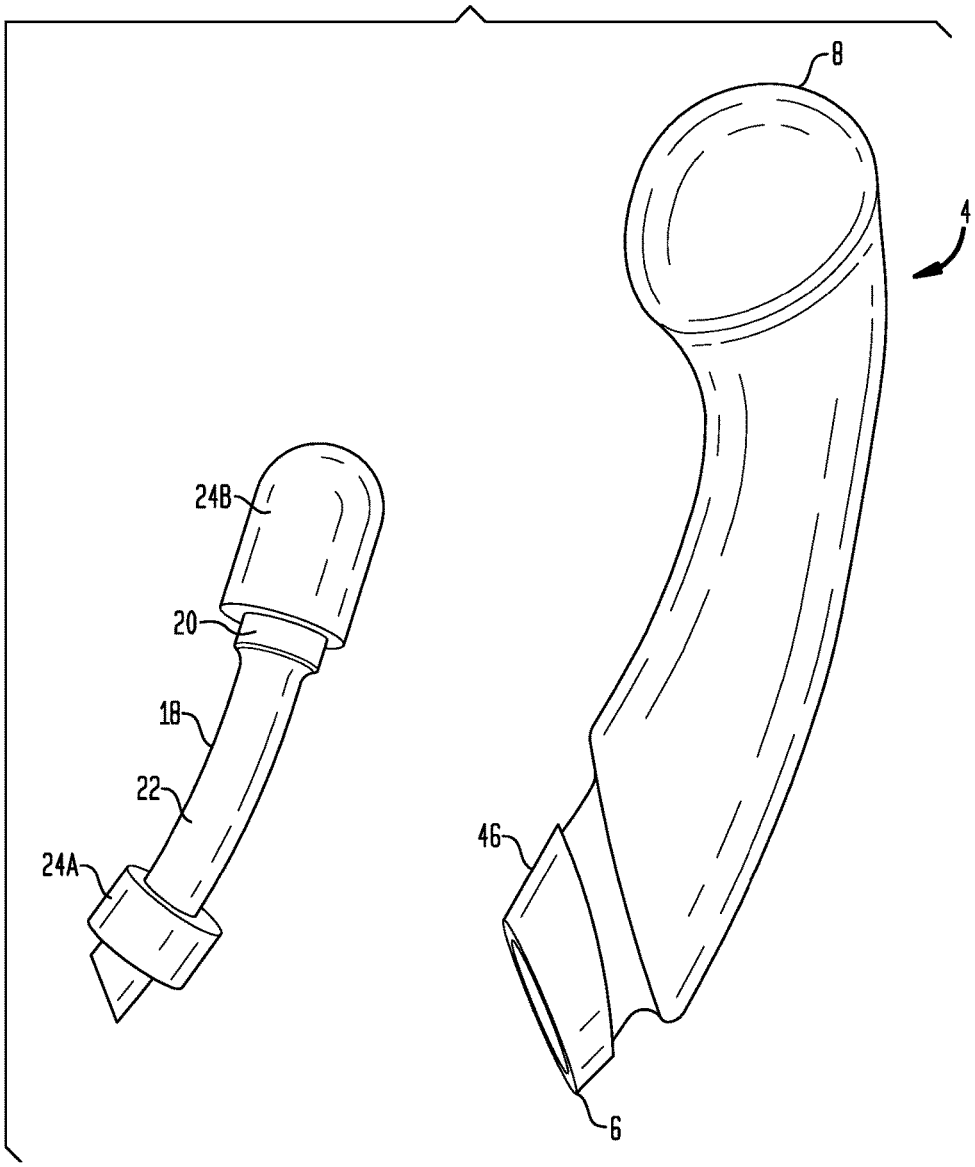
FIG. 5 is an exploded side view of a glass vibration head of the massager of FIG. 1 prior to installation of a vibration motor assembly and related components in the glass vibration head.

As shown in FIGS. 4-5, a electric vibration motor assembly 14 is disposed in the vibration head interior compartment 12. As shown in FIG. 3, the vibration motor assembly 14 may include a vibration motor 16 disposed within a vibration motor housing 18. The vibration motor 16 may be a vibration-inducing electric motor of conventional design. The vibration motor housing 18 may be formed from two motor housing halves 18A and 18B made from plastic or the like. In an embodiment, the vibration motor housing 18 may include an enlarged end portion 20 that is sized to receive the vibration motor 14, and an elongated stem portion 22 of reduced size for housing electrical wiring (not shown) that provides power to the vibration motor 16. The enlarged end portion 20 of the vibration motor housing 18 may be rounded, such that the end portion 20 is generally bullet shaped.

A vibration-transmitting interface 23 is disposed between the vibration motor assembly 14 and the vibration head wall 12 so that vibrations generated by the vibration motor 16 are imparted to the vibration head 4, causing the latter to vibrate. The vibration transmitting interface 23 may include one or more resilient shock absorbers 24 disposed between the vibration motor housing 18 and the vibration head wall 10. FIGS. 3-5 illustrate two resilient shock absorbers configured as foam elements 24A and 24B that mount to the vibration motor housing 18. The foam element 24A is shaped as a foam ring member that mounts onto the stem portion 22 of the vibration motor housing 18. Although one foam element 24A is shown in the illustrated embodiment, additional instances of this foam element could be added if desired. The foam element 24B is shaped as a closed-ended foam cap member that mounts onto (and substantially covers) the enlarged end portion 20 of the vibration motor housing.

It will be seen in FIG. 4 that the vibration head interior compartment 12 may include a nonlinear curvature extending from the vibration head base end 6 to the vibration head free end 8. Within this curved compartment, the vibration motor assembly 14 may be spaced from the primary vibration head wall 10, but the resilient shock absorbers 24 will fill this space. In particular, the foam element 24A is disposed to fill the space between the stem portion 22 of the vibration motor assembly 18 and a side portion of the vibration head wall 10. The foam element 24B is disposed to fill the space between the enlarged stem portion 22 of the vibration motor assembly 18 and the side portion of the vibration head wall 10. In this way, the vibration motor housing 22 will be maintained in a fixed position, and will not rattle around inside the vibration head 4.

Figure 3A:
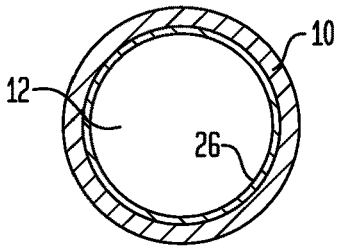
FIG. 3A is a cross-sectional view taken along lines 3A-3A in FIG. 3.

As shown in FIG. 4, an additional shock absorber, which can be embodied as a resilient wad 24C made of cotton or other fibrous material, may be placed in the vibration head interior compartment 12 so as to be disposed between the enlarged end portion 20 of the vibration motor housing 18 and the closed end the interior compartment. FIG. 3A further shows that the inside of the vibration head wall 10 may be coated with a liner 26 that may serve as another component of the vibration transmitting interface 16. The liner 36 may be constituted as a thin polymeric material layer that may be opaque and somewhat resilient. The opacity of the liner 36 may be advantageous when the glass used to form the vibration head 4 is transparent or translucent and it is desired to hide the components therein. The resiliency of the liner 36 may be advantageous because it can provide additional shock absorption between the vibration motor 4 and the vibration head wall 10.

Returning now to FIGS. 1 and 2, the massager 2 further includes a non-glass base 28. As shown in FIG. 3, the base 28 may include a base housing 30 that can be formed from base housing halves 30A and 30B made from plastic or the like. A power source 32 and a control circuit 34 are disposed in the base housing 30. The power source 32 may be implemented as a rechargeable battery. The control circuit 34 includes a circuit board 36 that mount the control circuit's electrical components. The control circuit 34 is electrically connected, such as via wiring (not shown), to receive power from the power source 32 and deliver such power to the vibration motor 4 in a controlled manner. Respective power and mode control buttons 38 and 40 may be provided as part of the control circuit 34, allowing a user to control power to the vibration motor 14 in order to selectively change its mode of operation. A battery recharging receptacle 42 may be also be provided in the housing 30 so that the battery 38 can be recharged. The battery recharging receptacle 42 is electrically connected to the circuit board 36, and may constitute part of the control circuit 34.

Figure 6:
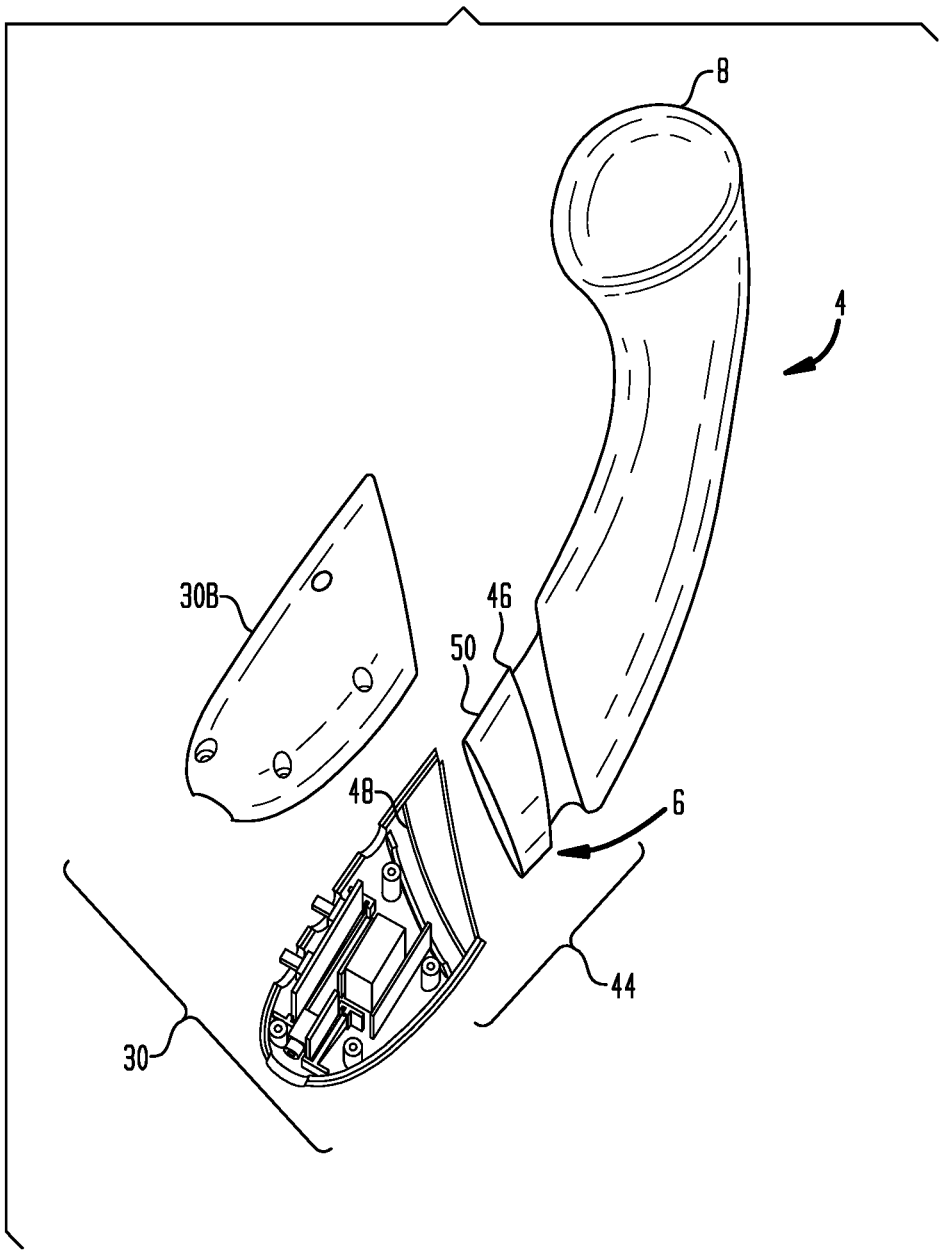
FIG. 6 is an exploded side view of the massager of FIG. 1 prior to a glass vibration head of the massager being mounted to a base of the massager.
Figure 7:
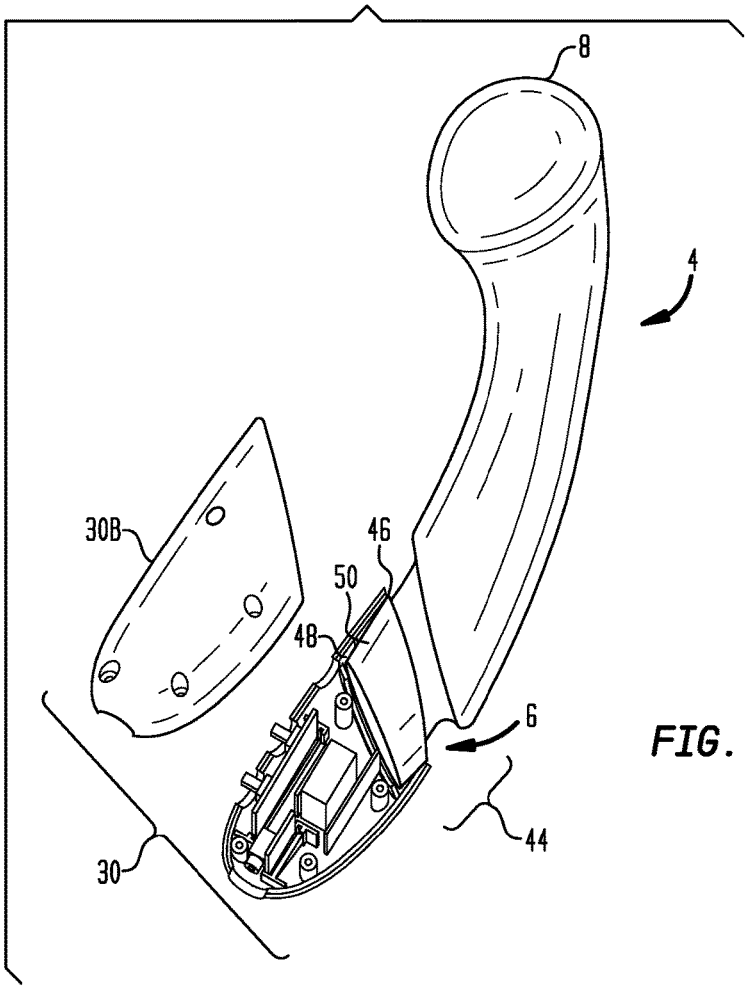
FIG. 7 is an exploded side view of the massager of FIG. 1 during a glass vibration head of the massager being mounted to a base of the massager.
Figure 8:
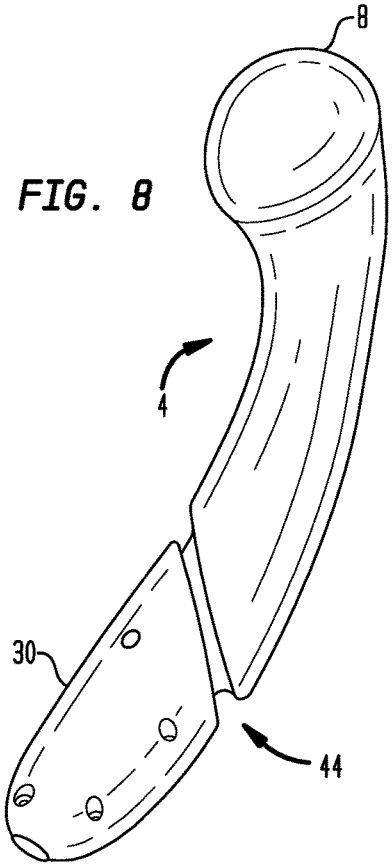
FIG. 8 is an exploded side view of the glass massager of FIG. 1 following a glass vibration head of the massager being mounted to a base of the massager.

Turning now to FIGS. 6-8, the base housing 32 and the vibration head base end may be joined in interlocking relationship at a head-base connection interface 44. The connection interface 44 may include a ring flange 46 formed on the vibration head base end 6 and a corresponding ring channel 48 formed on the base housing that receives the ring flange. The ring flange 46 may be additionally seen in FIGS. 3-5. As shown by these figures, the ring flange 46 may be tapered such that it is wider on one side of the vibration head base end 6 that on the other side thereof. Similarly, as best shown in FIGS. 3 and 6, the ring channel 48 may be correspondingly tapered to match the taper of the ring flange 46. As can be seen FIGS. 3 and 6-7, and a compressible gasket member 50 may be placed between the ring flange 46 and the ring channel 48 to ensure a tight fitting connection. The gasket member 50 may be formed in any suitable manner, with windings of a polymeric tape, such as plumbers tape, being one option.

Turning now to FIGS. 1-3, a resilient cover 52 made from silicone rubber or the like may be provided to cover the base housing 30. The resilient cover 52 may be formed as a silicone sheath. It covers the entirety of the base housing 30 and may be formed with an arm portion that defines a secondary vibration head 54. As shown in FIGS. 1-2, the secondary vibration head 54 extends from the base 28 housing. As shown in FIG. 3, the secondary vibration head 54 may have a secondary vibration motor assembly 56 disposed therein that is electrically connected to the control circuit 34. The secondary vibration motor assembly 56 may include a secondary vibration motor 58 disposed within a secondary vibration motor housing 60 that includes two motor housing halves 60A and 60B made from plastic or the like.

During operation of the massager 2, the glass vibration head 4 serves as a primary vibration head that receives vibrations from the vibration motor assembly 18 via the vibration transmitting interface 23. These vibrations may be used to massage a first human body portion. The secondary vibration head 54 receives vibrations from the secondary vibration motor assembly 56. These vibrations may be used to massage a second human body portion.

Accordingly, a vibrating glass massager has been disclosed. Although various embodiments have been described, it should be apparent that many variations and alternative embodiments could be implemented. It is understood, therefore, that the invention is not to be in any way limited except in accordance with the spirit of the appended claims and their equivalents.

What is claimed is:

1. A vibrating glass massager, comprising:

a glass vibration head having a base end, a free end, and a wall defining a hollow interior compartment that is closed at said vibration head free end and open at said vibration head base end;

a vibration motor assembly disposed in said vibration head interior compartment;

said vibration motor assembly being spaced from said vibration head wall;

a resilient vibration-transmitting interface between said vibration motor assembly and said vibration head wall;

said vibration transmitting interface comprising one or more resilient shock absorbers filling one or more spaces between said vibration motor assembly and said vibration head wall;

a non-glass base having a base housing;

said base housing and said vibration head base end being joined in interlocking relationship at a head-base connection interface;

a power source and a control circuit in said base housing;

said control circuit being electrically connected to said power source and to said vibration motor assembly; and whereby said glass vibration head is operable to deliver vibrations received from said vibration motor assembly via said vibration transmitting interface.

2. The vibrating glass massager of claim 1, wherein said vibration motor assembly comprises a vibration motor disposed within a vibration motor housing.

3. The vibrating glass massager of claim 1, wherein said vibration transmitting interface comprises one or more resilient shock absorbers disposed between a side portion of said vibration motor assembly and a side portion said vibration head wall, and a shock absorber disposed between an end of said vibration motor assembly and said closed end of said vibration head interior compartment.

4. The vibrating glass massager of claim 1, wherein said vibration transmitting interface comprises one or more foam elements disposed between said vibration motor assembly and said vibration head wall.

5. The vibrating glass massager of claim 1, wherein said vibration transmitting interface comprises one or more foam elements disposed between said vibration motor assembly and a side portion of said vibration head wall, and further comprises cotton wadding disposed between said vibration motor assembly and said closed end of said vibration head interior compartment.

6. The vibrating glass massager of claim 1, wherein said head-base connection interface comprises a ring flange formed on said vibration head base end and a corresponding ring channel formed on said base housing that receives said ring flange, and a gasket member between said ring flange and said channel.

7. The vibrating glass massager of claim 1, further including an opaque coating on an interior of said vibration head wall.

8. The vibrating glass massager of claim 1, further including a resilient cover on said base housing.

9. The vibrating glass massager of claim 1, wherein said vibration head interior compartment comprises a nonlinear curvature extending from said vibration head base end to said vibration head free end.

10. A vibrating glass massager, comprising:

a primary glass vibration head having a base end, a free end, and a wall defining a hollow interior compartment that is closed at said primary vibration head free end and open at said primary vibration head base end;

a primary vibration motor assembly disposed in said primary vibration head interior compartment;

a resilient vibration-transmitting interface between said primary vibration motor assembly and said primary vibration head wall;

a non-glass base having a base housing;

said base housing and said primary vibration head base end being joined in interlocking relationship at a head-base connection interface;

a power source and a control circuit in said base housing;

said control circuit being electrically connected to said power source and to said primary vibration motor assembly;

a secondary non-glass vibration head extending from said base;

a secondary vibration motor assembly in said secondary vibration head;

said secondary vibration motor assembly electrically connected to said control circuit;

a resilient cover on said base housing, said resilient cover defining said secondary vibration head; and whereby said primary vibration head is operable to deliver vibrations received from said primary vibration motor assembly via said vibration transmitting interface and said secondary vibration head is operable to deliver vibrations received from said secondary vibration motor assembly.

11. The vibrating glass massager of claim 10, wherein said primary vibration motor assembly comprises a primary vibration motor disposed in a primary vibration motor housing.

12. The vibrating glass massager of claim 10, wherein said vibration transmitting interface comprises one or more resilient shock absorbers disposed between said primary vibration motor assembly said primary vibration head wall.

13. The vibrating glass massager of claim 10, wherein said vibration transmitting interface comprises one or more resilient shock absorbers disposed between a side portion of said primary vibration motor assembly and a side portion said primary vibration head wall, and a shock absorber disposed between an end of said primary vibration motor assembly and said closed end of said primary vibration head interior compartment.

14. The vibrating glass massager of claim 10, wherein said vibration transmitting interface comprises one or more foam elements disposed between said primary vibration motor assembly a side portion of said primary vibration head wall.

15. The vibrating glass massager of claim 10, wherein said vibration transmitting interface comprises one or more foam elements disposed between said primary vibration motor assembly and a side portion of said primary vibration head wall, and further comprising cotton wadding disposed between said primary vibration assembly and said closed end of said primary vibration head interior compartment.

16. The vibrating glass massager of claim 10, wherein said head-base connection interface comprises a ring flange formed on said primary vibration head base end and a corresponding ring channel formed on said base housing that receives said ring flange, and a gasket member between said ring flange and said channel.

17. The vibrating glass massager of claim 10, further including an opaque coating on an interior of said primary vibration head wall.

18. The vibrating glass massager of claim 10, wherein said primary vibration head interior compartment comprises a nonlinear curvature extending from said primary vibration head base end to said primary vibration head free end, and wherein said primary vibration head motor assembly is spaced from said primary vibration head wall.

19. A vibrating glass massager, comprising:

a primary glass vibration head having a base end, a free end, and a wall defining a hollow interior compartment that is closed at said primary vibration head free end and open at said primary vibration head base end;

a primary vibration motor assembly disposed in said primary vibration head interior compartment;

a resilient vibration-transmitting interface between said primary vibration motor and said primary vibration head wall;

a non-glass base having a base housing;

said base housing and said primary vibration head base end being joined in interlocking relationship at a head-base connection interface;

a power source and a control circuit in said base housing;

said control circuit being electrically connected to said power source and to said primary vibration motor;

a secondary non-glass vibration head extending from said housing;

a secondary vibration motor assembly in said secondary vibration head;

said secondary vibration motor being electrically connected to said control circuit;

a resilient cover on said base housing, said resilient cover defining said secondary vibration head;

said vibration transmitting interface comprising one or more resilient side shock absorbers disposed between a side portion of said primary vibration motor assembly and a side portion said primary vibration head wall, and an end shock absorber disposed between an end of said primary vibration motor assembly and said closed end of said primary vibration head interior compartment;

said one or more side shock absorbers comprising one or more foam elements;

said end shock absorber comprising cotton wadding;

said head-housing connection interface comprising a ring flange formed on said primary vibration head base end, a corresponding ring channel formed on said base housing that receives said ring flange, and a gasket member between said ring flange and said channel;

an opaque coating on an interior of said primary vibration head wall;

said primary vibration head interior compartment comprising a nonlinear curvature extending from said primary vibration head base end to said primary vibration head free end, and said primary vibration head motor assembly being spaced from said primary vibration head wall; and whereby said primary vibration head is operable to deliver vibrations received from said primary vibration motor assembly via said vibration transmitting interface and said secondary vibration head is operable to deliver vibrations received from said secondary vibration motor assembly.

* * * * *